US009242135B2

(12) United States Patent
Schmidt

(10) Patent No.: US 9,242,135 B2
(45) Date of Patent: Jan. 26, 2016

(54) BENCH PRESS NECK GUARD

(71) Applicant: Andrew Schmidt, Milltown, NJ (US)

(72) Inventor: Andrew Schmidt, Milltown, NJ (US)

(73) Assignee: Andrew Schmidt, Milltown, NJ (US)

( * ) Notice: Subject to any disclaimer, the term of this patent is extended or adjusted under 35 U.S.C. 154(b) by 41 days.

(21) Appl. No.: 14/315,342

(22) Filed: Jun. 26, 2014

(65) Prior Publication Data

US 2015/0011367 A1 Jan. 8, 2015

Related U.S. Application Data

(60) Provisional application No. 61/957,163, filed on Jun. 26, 2013.

(51) Int. Cl.

| | |
|---|---|
| ***A63B 21/078*** | (2006.01) |
| ***A63B 21/00*** | (2006.01) |
| *A63B 23/00* | (2006.01) |

(52) U.S. Cl.

CPC ..... *A63B 21/078* (2013.01); *A63B 21/1407* (2013.01); *A63B 2021/0786* (2013.01); *A63B 2023/006* (2013.01)

(58) Field of Classification Search

CPC ..... A63B 21/078

See application file for complete search history.

(56) References Cited

U.S. PATENT DOCUMENTS

| | | | | |
|---|---|---|---|---|
| 4,757,998 A * | 7/1988 | Landin | A63B 21/078 482/104 |
| 5,217,421 A * | 6/1993 | Chrysler | A63B 21/078 482/104 |
| 9,132,313 B2 * | 9/2015 | Jones | A63B 21/078 |

* cited by examiner

*Primary Examiner* — Loan H Thanh
*Assistant Examiner* — Rae Fischer

(57) ABSTRACT

A portable lifesaving device that prevents a falling weight bar from injuring the neck while a weightlifter performs a bench press, including, two rods forming a "V" shape guard that rests horizontally over the neck (chest height) and is supported by two pillars at one end and by the chest at the other end, two pillars resting on the bench closely on each side of the neck, a crossbeam(s) that secures the pillars, a cushion under the converging end of the rods protecting the chest, two hooks positioned under the bottom of the bench, two bars the hooks to the top outside of the pillars preventing lateral collapse of the device, elastic straps pulling the bars and hooks inward to secure the hooks under the bench, and a bar on the crossbeam preventing a fallen weight bar from rolling onto the head.

1 Claim, 8 Drawing Sheets

BENCH PRESS NECK GUARD

This application claims the benefit of 61/957,163 (Jun. 26, 2013).

FIELD OF INVENTION

This invention relates to exercise fitness safety and specifically for weightlifting, and even more specifically for the bench press.

DESCRIPTION OF PRIOR ART

The bench press has historically been the best method of weight training to build chest muscles and chest strength. Protecting the neck is a major safety concern while performing a bench press as heavy weights are used because the chest muscles are some of the largest muscles in the human body. The bench press is an exercise whereby a weightlifter, while resting horizontally on the bench, pushes the weight bar vertically up and down over the chest. Thusly, a falling weight bar could easily fall onto a weightlifter's neck causing death. It is also worth noting that experts in the study of Multiple Sclerosis have recently prescribed bench pressing as a way to help combat and ease the symptoms of the disease. My invention is a portable lifesaving device that does not require any legs that extend to the floor or any supports being fastened to the weightlifting bench itself, as is the case in prior art U.S. Pat. No. 4,757,998. My invention has the preferred embodiment of two support pillars that are placed around the neck as they rest directly on top of the bench. This feature makes my apparatus uniquely portable as the entire device takes up the area of one square foot. Another original feature of my invention is the pair of side hooks that prevents the device from collapsing laterally if the falling weight bar forces the device to the lean to the left or right.

SUMMARY OF THE INVENTION

This invention has the preferred embodiment of a "V"-shaped pair of rods that rest horizontally over the neck area as the weightlifter rests flat on the weight bench. The protective rods are supported on one end by two 10" vertical pillars that are placed closely around the weightlifter's neck. The two pillars are connected and secured at the top by a crossbeam. The chest area between the nipples is used as the support at the other end of the converging rods with a protective cushion underneath the rods to protect the chest.

DETAILED DESCRIPTION OF THE DRAWINGS

Figure 1:
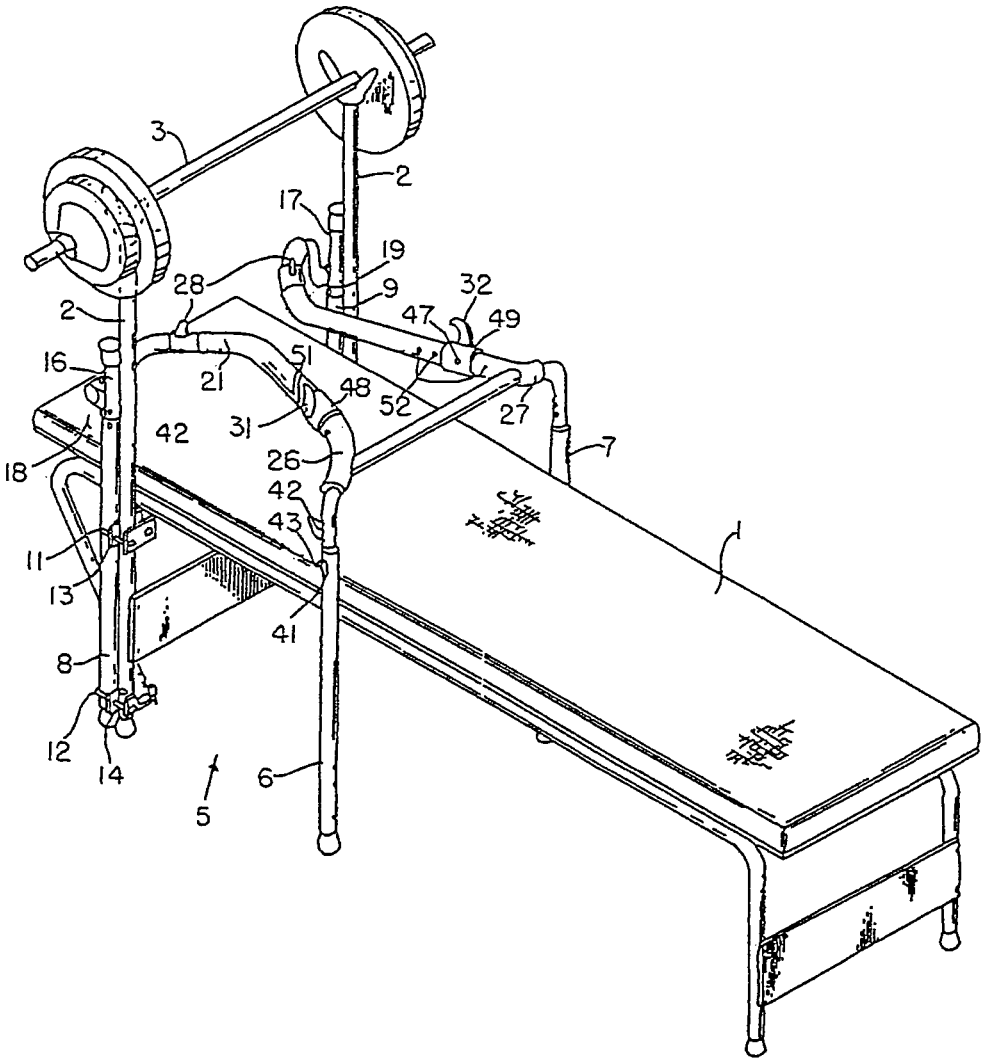
FIG. 1 (Prior Art)
FIG. 1 is a drawing of prior art U.S. Pat. No. 4,757,998.

Referring to:

FIG. 1, the prior art drawing of U.S. Pat. No. 4,757,998 reveals a device that lacks portability as it manifests four legs 6, 7, 8, 9 that extend to the floor. Also note two of the legs 8 and 9 are fastened apparently with screws to the legs of the bench itself, thusly making the device significantly different from the preferred embodiment and design of my invention.

Figure 2:
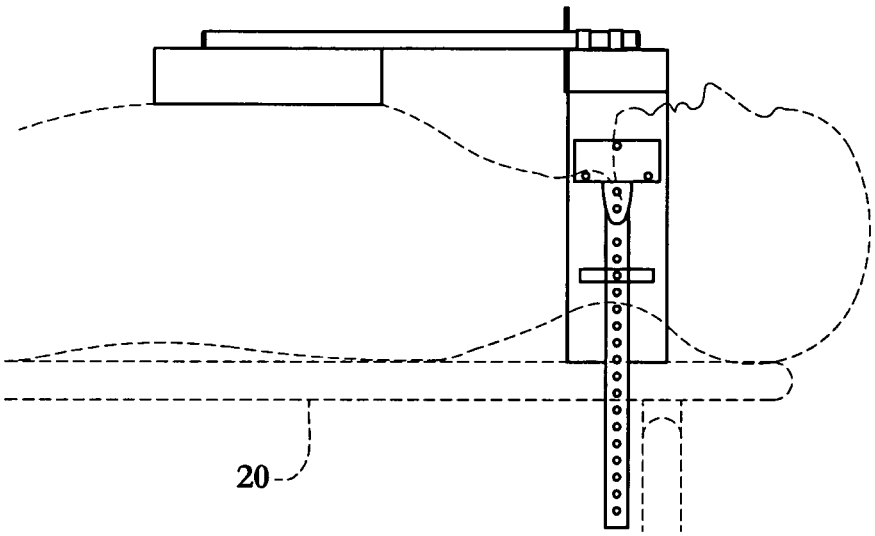
FIG. 2 is a side view showing exactly where the weightlifter positions the device around the neck.

FIG. 2 shows a side view of exactly where the device is placed around the weightlifter's neck as it rests on the bench 20, so as to leave no room for the falling weight bar to land on the neck or throat.

Figure 3:
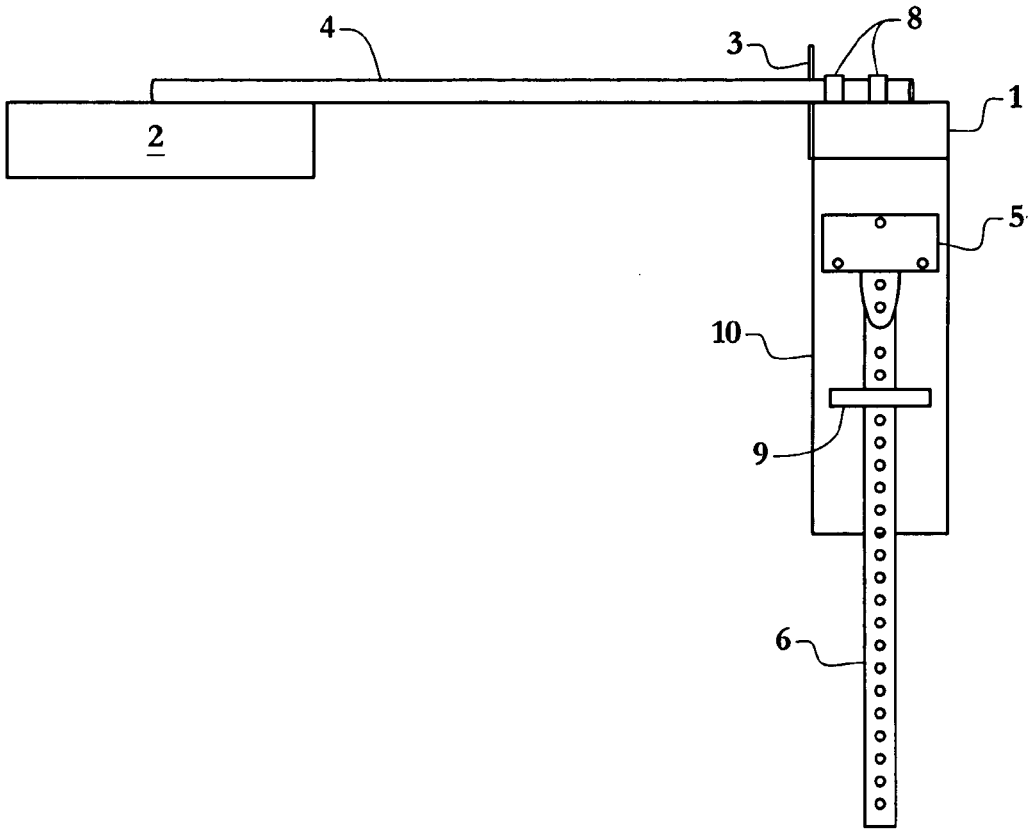
FIG. 3 is showing all the specific labeled parts.

FIG. 3 shows a side view of the device with the horizontal protective rods 4, the cushion 2 that rests under the rods 4 where they converge, the small bar 3 which is connected to the crossbeam 1 and keeps a fallen weight bar from rolling toward the head, the clamps 8 which secure the rods 4 to the crossbeam 1, the vertical side bar 6 which is connected to the hinge 5 and is pulled inward toward the pillar 10 by the elastic strap 9.

Figure 4:
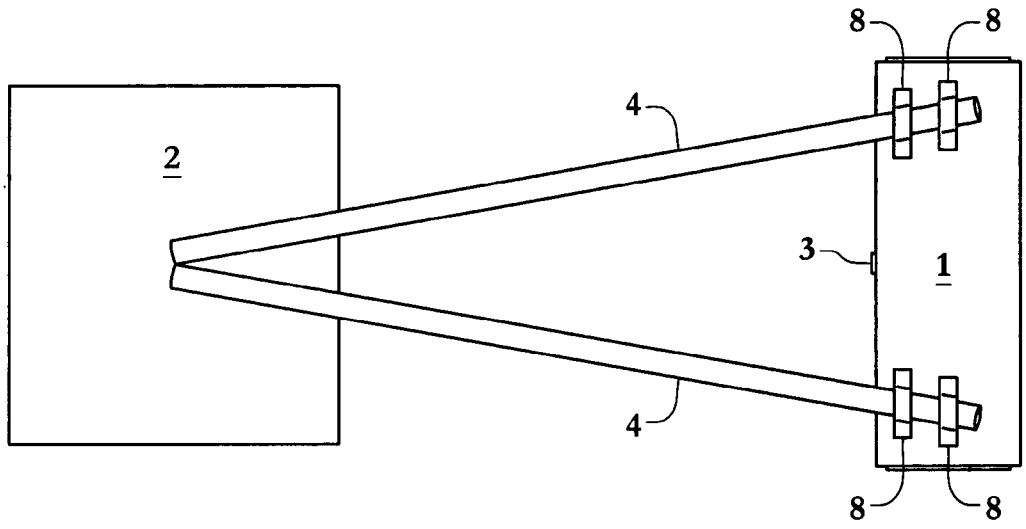
FIG. 4 is an overhead view looking directly straight down at the device from the ceiling.

FIG. 4 is an overhead view from the ceiling looking straight down at the device showing the cushion 2 as it rests under the two rods 4 that stop a falling weight bar from crushing the neck, the small bar 3 that keeps an already fallen weight bar from rolling on the rods 4 toward the head, the four clamps 8 that secure the two rods to the crossbeam 1.

Figure 5:
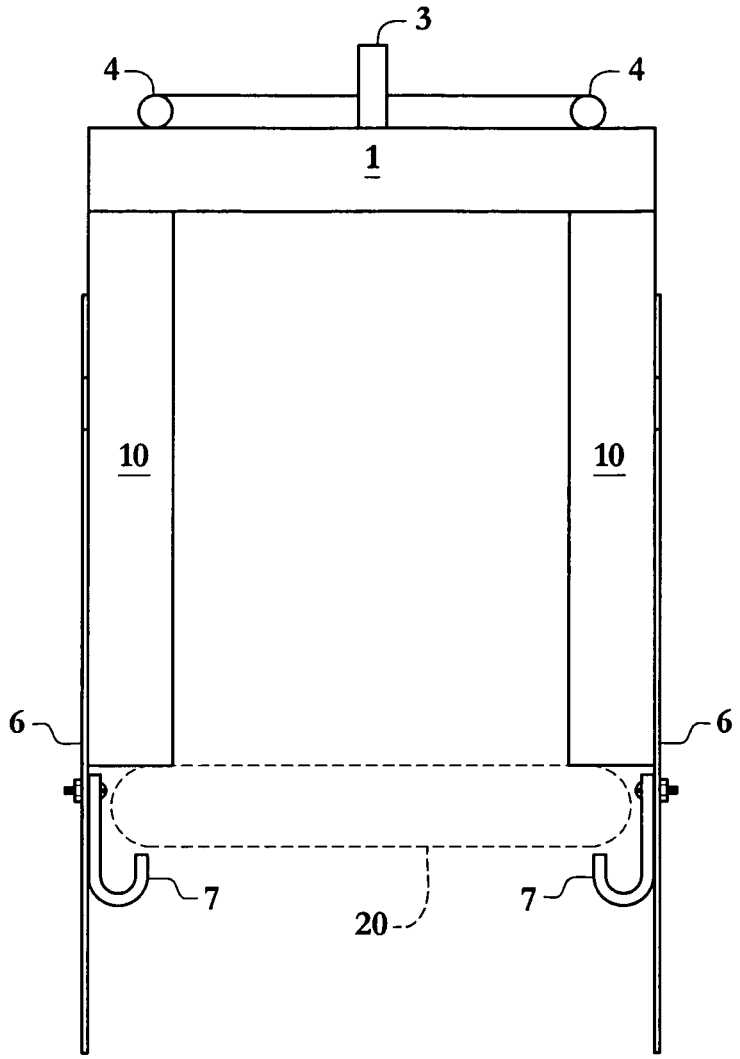
FIG. 5 is a level view showing how the hooks grab the bottom of the bench.
Figure 6:
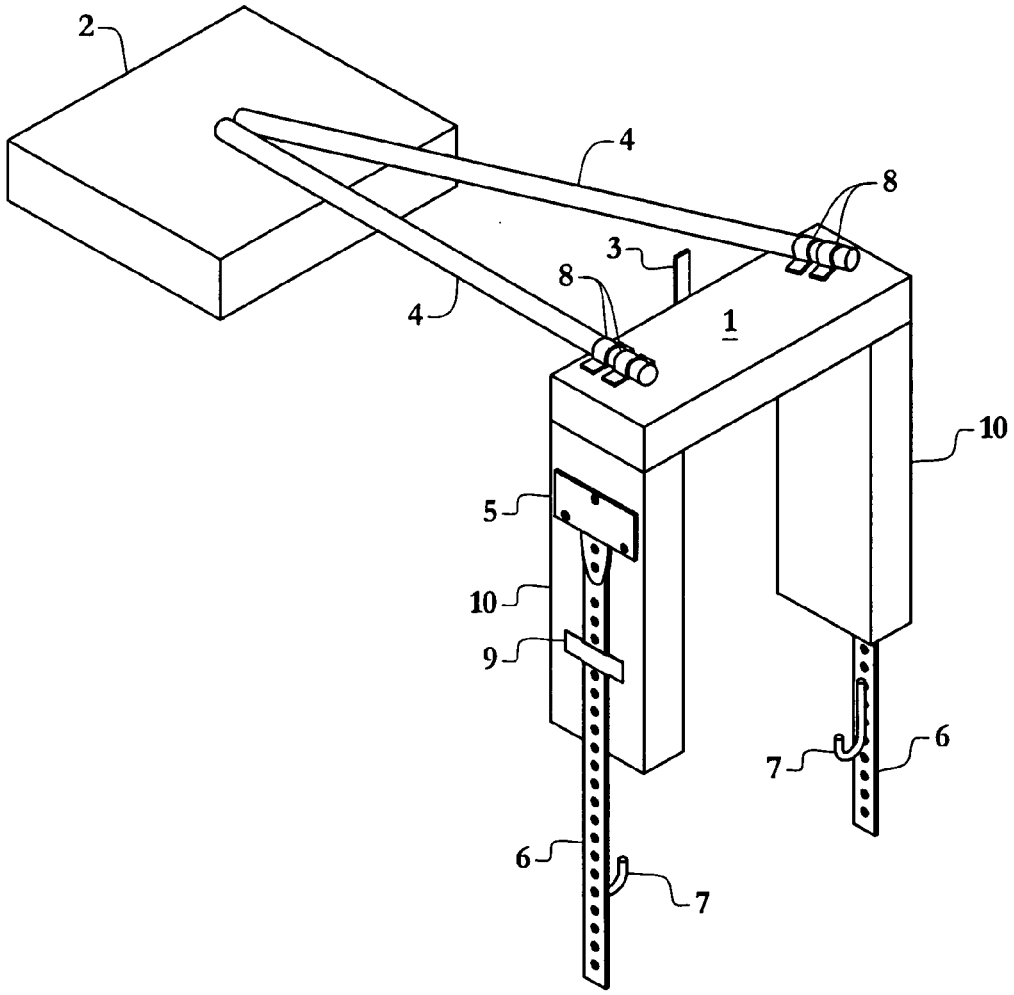
FIG. 6 is a complete view of the assembled device with all parts labeled.

FIG. 5 is a rear view that looks at the device from the top of weightlifter's head. This view shows how the hooks 7 are positioned to grasp the bottom of the bench 20 to prevent lateral collapse. Also in view are the two pillars 10 that rest on the bench 20, along with the crossbeam 1, the small bar 3, the two rods 4, FIG. 6 shows the entire assembled device from an elevated angle with all the parts including the crossbeam 1 which secures the two vertical pillars 10, the cushion 2 which protects the chest from the two rods 4 as the heavy weight bar falls on them, the small bar 3 which is connected to the crossbeam 1 and prevents a fallen weight bar from rolling toward and crushing the head, the two hooks 7 which prevent the lateral collapse of the device and are connected to the side bars 6 which are connected to the hinges 5 which are connected to the pillars 10, the elastic straps 9 which pull the side bars 6 inward causing the hooks 7 to remain under the bench.

Figure 7:
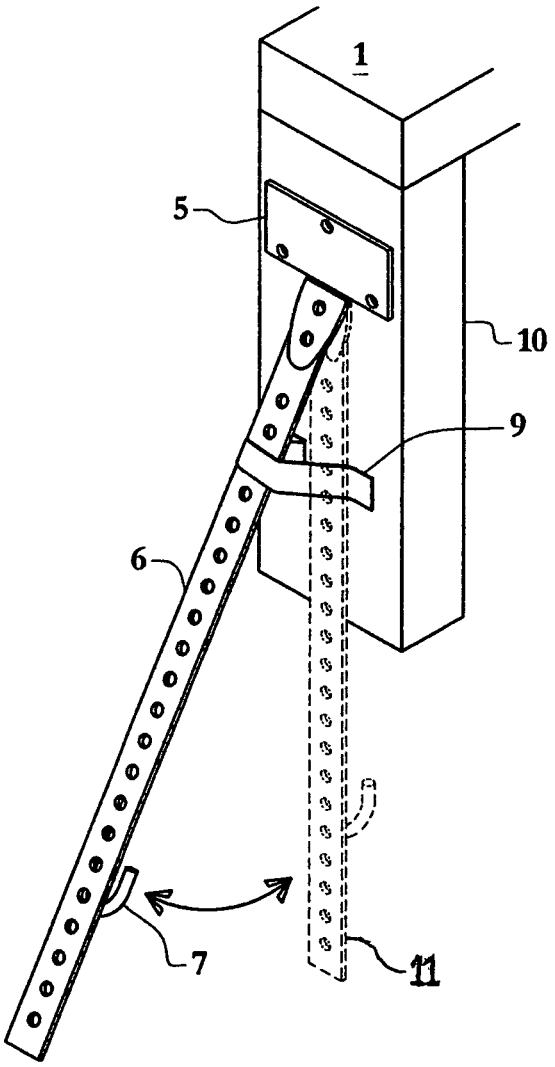
FIG. 7 is a view that shows how the elastic straps pull the hooks inward and under the bench.

FIG. 7 shows how side bar 6 is pulled outward by the weightlifter until the pillars 10 are resting on the bench. Then the elastic strap 9 forcefully pulls side bar 6 inward until it is pressed against the pillar 10 with the resulting view being manifested by a view of side bar 11.

Figure 8:
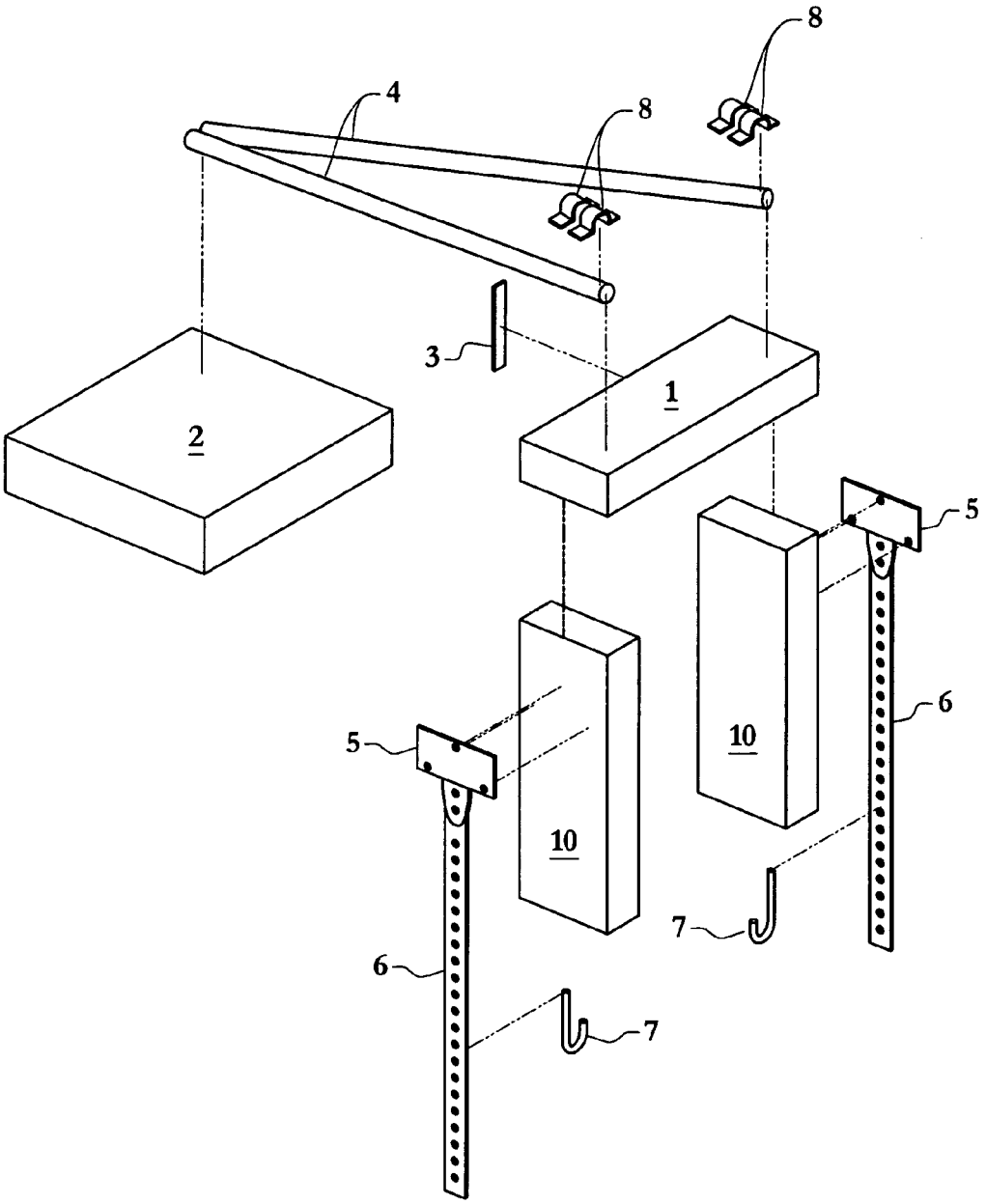
FIG. 8 is a view showing how all the disassembled parts come together to form the assembled structure.

FIG. 8 shows a detached view of the main parts of the invention. The pillars 10 connect to the crossbeam 1. The rods 4 connect to the crossbeam 1 with clamps 8. The small bar 3 connects to the crossbeam 1. The hinges 5 connect to the pillars 10. The side bars 6 connect to the hinges 5 as the hooks 7 connect to the bottom of the side bars 6.

The invention claimed is:

1. A weightlifting safety device adapted to protect a user's neck from a falling weight bar while performing a bench press, comprising:

a) two metal rods that form a V-shape as they rest horizontally over the user's neck area, adapted for preventing a falling weight bar from crushing a weightlifter's neck or throat while performing a bench press, wherein, if the user accidentally drops the weight bar down toward the chest or neck, the two rods will tend to urge the weight bar to be unbalanced and fall to the ground;

b) two vertical pillars configured to be placed closely alongside the weightlifter's neck while performing a bench press, and to support the more widely spaced ends of the two metal rods;

c) a crossbeam that connects and secures the two vertical pillars at the top thereof, wherein the two metal rods are fastened to the top of the crossbeam directly over the two pillars;

d) a small bar connected to the crossbeam and configured to prevent the falling weight bar from rolling toward the user's head;

e) two hinges, wherein one hinge is fastened to each pillar near the top;

f) two vertical bars, wherein one vertical bar is connected to each of the hinges and is thereby pivotally connected to the corresponding pillar, and wherein each vertical bar is thereby configured to swing toward and away from the user;

g) two hooks, wherein one hook is positioned on each of the vertical bars, and wherein each hook is configured to grasp an exercise bench and tends to prevent lateral collapse of the device;

i) two elastic straps, wherein each elastic strap is stretched out and fastened on each pillar outside of the corresponding vertical bar and is adapted to force the bar and the corresponding hook toward the pillar, enabling the hooks to grasp the exercise bench;

j) a protective cushion fastened under the apex of the two metal rods, positioned to rest on the user's chest between the user's nipples, and adapted to protect the user's chest after a weight bar drops on the metal rods; and k) four clamps positioned on the surface of the crossbeam opposite the pillars, wherein two of the clamps are configured to attach each of the metal rods to the crossbeam such that the rods are angled forming the V shape.

* * * * *